US011903445B2

(12) United States Patent
Cheney et al.

(10) Patent No.: US 11,903,445 B2
(45) Date of Patent: Feb. 20, 2024

(54) FOOTWEAR COMPRISING A DYNAMIC MATERIAL EXHIBITING TOPOGRAPHIC TRANSFORMATION

(71) Applicant: FAST IP, LLC, Lindon, UT (US)

(72) Inventors: Craig Cheney, Lindon, UT (US); Seth Munger, Springville, UT (US)

(73) Assignee: FAST IP, LLC, Lindon, UT (US)

( * ) Notice: Subject to any disclaimer, the term of this patent is extended or adjusted under 35 U.S.C. 154(b) by 0 days.

(21) Appl. No.: 17/827,947

(22) Filed: May 30, 2022

(65) Prior Publication Data

US 2022/0287413 A1 Sep. 15, 2022

Related U.S. Application Data

(63) Continuation of application No. PCT/US2021/012543, filed on Jan. 7, 2021.

(60) Provisional application No. 62/958,063, filed on Jan. 7, 2020.

(51) Int. Cl.
*A43B 23/02* (2006.01)
*A43B 1/00* (2006.01)

(52) U.S. Cl.
CPC ..... *A43B 23/0265* (2013.01); *A43B 1/0018* (2013.01)

(58) Field of Classification Search
CPC ..... A43B 1/0018; A43B 23/0265
USPC ..... 36/55
See application file for complete search history.

(56) References Cited

U.S. PATENT DOCUMENTS

| | | | | |
|---|---|---|---|---|
| 1,830,648 | A | 11/1931 | Engel | |
| 2,112,052 | A | 3/1938 | Smith | |
| 2,776,499 | A | 1/1957 | Guintini | |
| 3,541,708 | A | 11/1970 | Rosen | |
| 4,083,128 | A | 4/1978 | Rossman | |
| 4,813,157 | A | 3/1989 | Boisvert et al. | |
| 4,968,492 | A | 11/1990 | Rosen | |
| 5,036,604 | A | 8/1991 | Rosen | |
| 5,203,096 | A | 4/1993 | Rosen | |
| 5,241,762 | A | 9/1993 | Rosen | |
| 5,768,803 | A | 6/1998 | Levy | |
| 5,813,146 | A | 9/1998 | Gutkowski et al. | |
| 6,000,147 | A | 12/1999 | Kellerman | |
| 6,119,371 | A * | 9/2000 | Goodwin | B29C 66/133 428/69 |
| 6,442,874 | B1 | 9/2002 | Long | |
| 6,450,510 | B1 | 9/2002 | Liu | |
| 6,920,707 | B1 | 7/2005 | Greene et al. | |

(Continued)

FOREIGN PATENT DOCUMENTS

| | | |
|---|---|---|
| CN | 203969442 U | 12/2014 |
| CN | 108851327 A | 11/2018 |

(Continued)

OTHER PUBLICATIONS

International Search Report and Written Opinion dated Mar. 18, 2021 in PCT International Patent Application No. PCT/US2021/012543.

(Continued)

*Primary Examiner* — Timothy K Trieu

(57) ABSTRACT

An upper of an article of footwear including a dynamic material configured for topographic transformation to alter at least one of a fit, an insulation, or a ventilation, of the article of footwear.

5 Claims, 13 Drawing Sheets

(56) References Cited

U.S. PATENT DOCUMENTS

| | | | | |
|---|---|---|---|---|
| 7,055,268 | B2 | 6/2006 | Ha | |
| 7,225,563 | B2 | 6/2007 | Chen et al. | |
| 7,392,604 | B2 | 7/2008 | Greene et al. | |
| 7,610,696 | B2 | 11/2009 | Davis | |
| 7,634,861 | B2 | 12/2009 | Kilgore | |
| 7,917,981 | B1 | 4/2011 | Lakic | |
| 9,301,571 | B2 | 4/2016 | Langvin | |
| 9,491,983 | B2 | 11/2016 | Rushbrook | |
| 9,808,045 | B2 | 11/2017 | Carlson et al. | |
| 10,159,302 | B2 | 12/2018 | Carlson et al. | |
| 10,499,707 | B2 * | 12/2019 | Hobson | A43B 23/0285 |
| 10,588,382 | B2 | 3/2020 | Rushbrook | |
| 10,602,797 | B2 | 3/2020 | Lintaman | |
| 10,645,990 | B2 | 5/2020 | Rushbrook | |
| 10,667,579 | B2 | 6/2020 | Elder et al. | |
| 10,736,379 | B2 | 8/2020 | Cook et al. | |
| 10,765,170 | B2 | 9/2020 | Langvin et al. | |
| 10,765,175 | B2 | 9/2020 | Panian et al. | |
| 10,779,607 | B1 | 9/2020 | Chandel | |
| 10,827,800 | B2 | 11/2020 | Iannuzzi | |
| 10,827,803 | B2 | 11/2020 | Bell et al. | |
| 11,033,072 | B2 | 6/2021 | Oda | |
| 11,044,962 | B2 | 6/2021 | Cheung | |
| 2002/0178614 | A1 | 12/2002 | Issler | |
| 2005/0060913 | A1 | 3/2005 | Chil et al. | |
| 2006/0107552 | A1 | 5/2006 | Clark et al. | |
| 2006/0162191 | A1 | 7/2006 | Mason | |
| 2008/0127518 | A1 | 6/2008 | Byrne et al. | |
| 2008/0178493 | A1 | 7/2008 | Scofield | |
| 2009/0172972 | A1 | 7/2009 | Rosen | |
| 2011/0185600 | A1 | 8/2011 | Malek | |
| 2013/0152426 | A1 | 6/2013 | Lederer | |
| 2013/0219744 | A1 | 8/2013 | Case et al. | |
| 2014/0041256 | A1 | 2/2014 | Espinola | |
| 2014/0123516 | A1 | 5/2014 | Cressman et al. | |
| 2014/0182167 | A1 | 7/2014 | James et al. | |
| 2014/0215770 | A1 | 8/2014 | Levesque et al. | |
| 2014/0237850 | A1 | 8/2014 | Hull | |
| 2014/0259752 | A1 | 9/2014 | Feldman | |
| 2015/0366288 | A1 | 12/2015 | Miller | |
| 2017/0056754 | A1 | 3/2017 | Yu et al. | |
| 2017/0188655 | A1 | 7/2017 | Carlson et al. | |
| 2018/0135213 | A1 * | 5/2018 | Bell | A43B 1/0009 |
| 2018/0242694 | A1 | 8/2018 | Webster | |
| 2018/0255872 | A1 | 9/2018 | Manasiya | |
| 2018/0325216 | A1 * | 11/2018 | Toronjo | A43B 23/0265 |
| 2019/0297988 | A1 | 10/2019 | Oden et al. | |
| 2019/0380430 | A1 | 12/2019 | Seid | |
| 2020/0008516 | A1 | 1/2020 | Chan et al. | |
| 2020/0046080 | A1 | 2/2020 | Burns et al. | |
| 2020/0253334 | A1 | 8/2020 | Elder et al. | |
| 2020/0352282 | A1 | 11/2020 | Drake | |
| 2020/0367604 | A1 | 11/2020 | Langvin et al. | |
| 2020/0375301 | A1 | 12/2020 | Cheung | |
| 2021/0037912 | A1 | 2/2021 | Spencer | |
| 2021/0204639 | A1 | 7/2021 | Yang | |
| 2021/0219651 | A1 | 7/2021 | Rushbrook et al. | |
| 2021/0227925 | A1 | 7/2021 | Kim | |

FOREIGN PATENT DOCUMENTS

| | | | | |
|---|---|---|---|---|
| CN | 109549280 | A | 4/2019 | |
| GB | 2432295 | A | 5/2007 | |
| KR | 100540394 | A | 12/2005 | |
| WO | 2006106612 | A2 | 10/2006 | |
| WO | WO-2018046756 | A1 * | 3/2018 | A41D 27/28 |

OTHER PUBLICATIONS

International Search Report and Written Opinion dated Mar. 18, 2021 for PCT/US2021/012543 filed Jan. 7, 2021, 6 pages.

* cited by examiner

FOOTWEAR COMPRISING A DYNAMIC MATERIAL EXHIBITING TOPOGRAPHIC TRANSFORMATION

CROSS-REFERENCE TO RELATED APPLICATION

This application is a continuation of, claims priority to and the benefit of PCT Serial No. PCT/US21/12543 filed Jan. 7, 2021 and entitled "FOOTWEAR COMPRISING A DYNAMIC MATERIAL EXHIBITING TOPOGRAPHIC TRANSFORMATION." PCT Serial No. PCT/US21/12543 claims the benefit of U.S. Provisional Patent Application No. 62/958,063, filed Jan. 7, 2020 and entitled "FOOTWEAR HAVING UPPER MATERIAL EXHIBITING TOPOGRAPHIC TRANSFORMATION." All of the aforementioned applications are incorporated herein by reference in their entireties.

FIELD

The present disclosure relates to footwear comprising a dynamic material exhibiting topographic transformation.

BACKGROUND

Whether due to growth, pregnancy, injury, swelling or activity (e.g., walking versus running), to name a few, the desired length and/or width of footwear may change over time, and do so before footwear is otherwise "worn out." The present disclosure addresses this need.

SUMMARY

An article of footwear in accordance with an embodiment of the present disclosure comprises a sole structure, and an upper coupled to the sole structure, wherein the upper comprises a dynamic material.

In some embodiments, the dynamic material is configured to exhibit a topographic transformation along a first axis in response to a tension or torque being applied to the dynamic material along a second axis orthogonal to the first axis, and the topographic transformation alters at least one of a fit, an insulation, or a ventilation, of the article of footwear.

In example embodiments, the dynamic material comprises a plurality of angled slits configured to expand along the first axis as an auxetic structure.

In example embodiments, the dynamic material comprises a plurality of layers coupled by a plurality of ribs, each of the plurality of ribs being configured to fold. In example embodiments, the ribs are linearly or radially aligned. In example embodiments, at least one of the layers comprises an aperture to provide the ventilation in connection with the topographic transformation.

In other embodiments, the dynamic material is configured to exhibit an increase in a thickness in response to an increase in length or width, and the increase in the thickness alters at least one of a fit, an insulation, or a ventilation, of the article of footwear.

In still other embodiments, the dynamic material is configured to exhibit a topographic transformation in a first plane in response to a tension or torque being applied to the dynamic material in a second plane out of the first plane, and the topographic transformation alters at least one of a fit, an insulation, or a ventilation, of the article of footwear.

BRIEF DESCRIPTION OF THE DRAWINGS

The accompanying drawings may provide a further understanding of example embodiments of the present disclosure and are incorporated in, and constitute a part of, this specification. In the accompanying drawings, only one shoe (either a left shoe or a right shoe) may be illustrated, however, it should be understood that in such instances, the illustrated shoe may be mirror-imaged so as to be the other shoe. The use of like reference numerals throughout the accompanying drawings is for convenience only, and should not be construed as implying that any of the illustrated embodiments are equivalent. The accompanying drawings are for purposes of illustration and not of limitation.

DETAILED DESCRIPTION

Figure 1A:
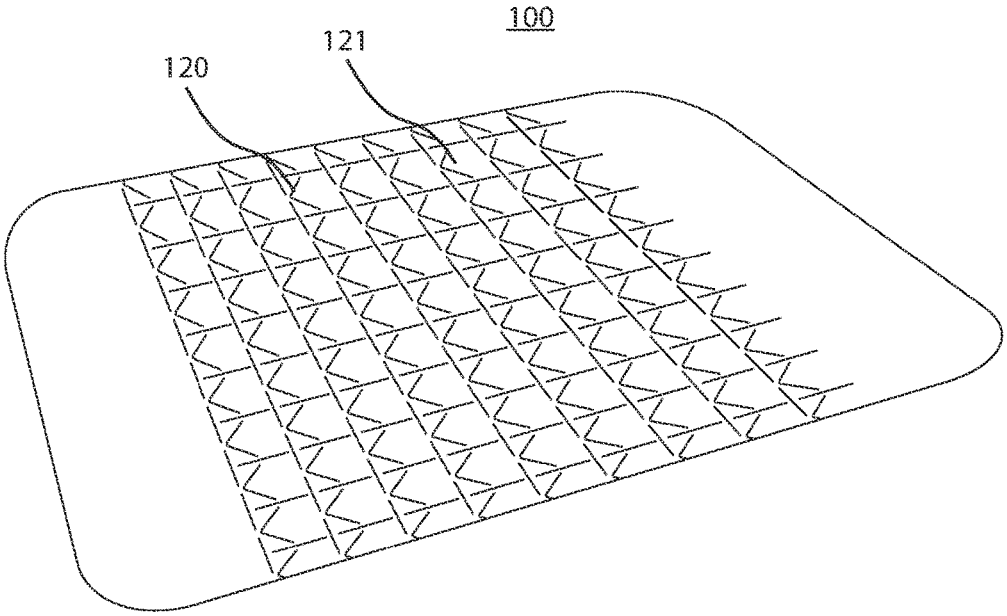
FIGS. 1A and 1B illustrate a dynamic material in closed and open configurations, respectively, in accordance with an example embodiment of the present disclosure.

Example embodiments of the present disclosure are described in sufficient detail in this detailed description to enable persons having ordinary skill in the relevant art to practice the present disclosure, however, it should be understood that other embodiments may be realized and that mechanical and chemical changes may be made without departing from the spirit or scope of the present disclosure. Thus, this detailed description is for purposes of illustration and not of limitation.

For example, unless the context dictates otherwise, example embodiments described herein may be combined with other embodiments described herein. Similarly, references to "example embodiment," "example embodiments" and the like indicate that the embodiment(s) described may comprise a particular feature, structure, or characteristic, but every embodiment may not necessarily comprise the particular feature, structure, or characteristic. Moreover, such references may not necessarily refer to the same embodiment(s). Any reference to singular includes plural embodiments, and any reference to plural includes singular embodiments.

Any reference to coupled, connected, attached or the like may be temporary or permanent, removeable or not, non-integral or integral, partial or full, and may be facilitated by one or more of adhesives, stitches, hook and loop fasteners, buttons, clips, grommets, zippers and other means known in the art or hereinafter developed.

As used herein, the transitional term "comprising", which is synonymous with "including," "containing," or "characterized by," is inclusive or open-ended and does not exclude additional, unrecited elements or method steps. The transitional phrase "consisting of" excludes any element, step, or ingredient not specified in the claim. The transitional phrase "consisting essentially of" limits the scope of a claim to the specified materials or steps "and those that do not materially affect the basic and novel characteristic(s)" of the claimed invention.

No claim limitation is intended to invoke 35 U.S.C. 112(f) or pre-AIA 35 U.S.C. 112, sixth paragraph or the like unless it explicitly uses the term "means" and includes functional language.

In describing example embodiments of the footwear comprising a dynamic material exhibiting topographic transformation, certain directional terms may be used. By way of example, terms such as "right," "left," "medial," "lateral," "front," "back," "forward," "backward," "rearward," "top," "bottom," "upper," "lower," "up," "down," and the like may be used to describe example embodiments of the footwear comprising a dynamic material exhibiting topographic transformation. These terms should be given meaning according to the manner in which the footwear comprising a dynamic material exhibiting topographic transformation is most typically designed for use, with the footwear comprising a dynamic material exhibiting topographic transformation on a user's foot and with the user's shod foot disposed on or ready for placement on an underlying surface. Thus, these directions may be understood relative to the footwear comprising a dynamic material exhibiting topographic transformation in such use. Similarly, as the footwear comprising a dynamic material exhibiting topographic transformation is intended primarily for use as footwear, terms such as "inner," "inward," "outer," "outward," "innermost," "outermost," "inside," "outside," and the like should be understood in reference to the footwear comprising a dynamic material exhibiting topographic transformation's intended use, such that inner, inward, innermost, inside, and the like signify relatively closer to the user's foot, and outer, outward, outermost, outside, and the like signify relatively farther from the user's foot when the footwear comprising a dynamic material exhibiting topographic transformation is being used for its intended purpose. Notwithstanding the foregoing, if the foregoing definitional guidance is contradicted by an individual use herein of any of the foregoing terms, the term should be understood and read according to the definition that gives life and meaning to the particular instance of the term.

As used herein, a "footwear" refers to an athleisure shoe, a casual shoe, a formal shoe, a dress shoe, a heel, a sports/athletic shoe (e.g., a tennis shoe, a golf shoe, a bowling shoe, a running shoe, a basketball shoe, a soccer shoe, a ballet shoe, etc.), a walking shoe, a sandal, a flip flop, a boot, or other suitable type of shoe. Additionally, footwear can be sized and configured to be worn by men, women, or children.

In accordance with example embodiments, the present disclosure provides for an adjustable shoe comprising a sole structure and an upper, the upper comprised of a dynamic material configured to provide for length and/or width adjustability of the shoe.

As used herein, "sole structure" refers to an outsole or portions thereof, a midsole or portions thereof, an insole or portions thereof, a wedge or portions thereof, or other suitable structure disposed between and/or adjacent to the foregoing parts of a shoe.

Figure 1B:
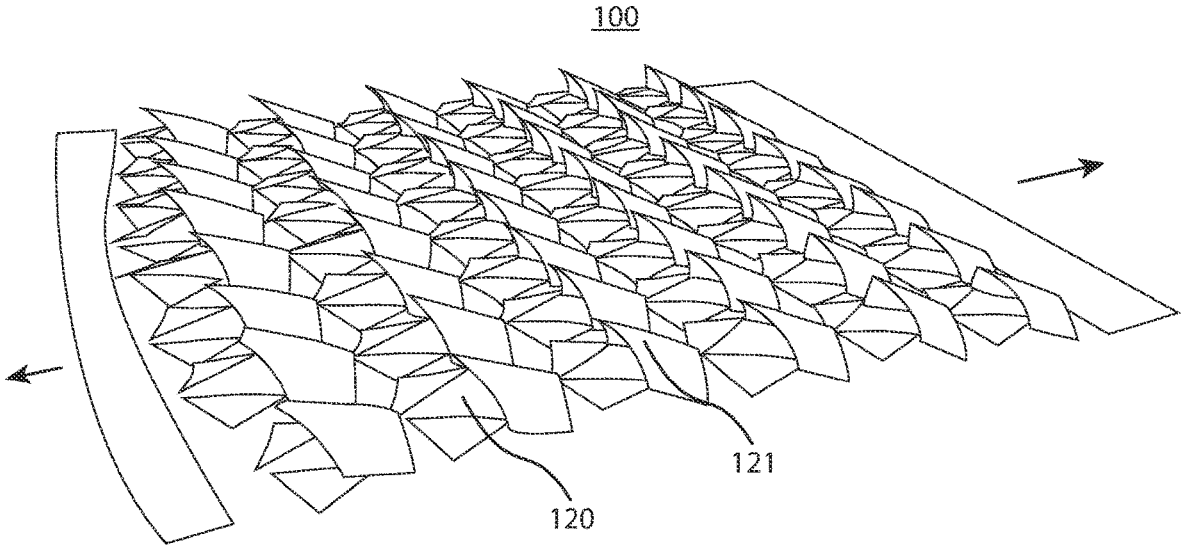

With reference to FIGS. 1A and 1B, the present disclosure comprises a dynamic material 100 exhibiting topographic transformation. In general, upon application of tension to a portion of the dynamic material 100 in a plane, the dynamic material 100 is configured to expand out of the plane, as an auxetic structure.

By way of example, upon application of tension to expand a portion of the dynamic material 100 in an X or Y dimension of a cartesian coordinate system (2D), the dynamic material 100 is configured to expand in a Z dimension of the cartesian coordinate system (3D) (while the dynamic material 110 changes or remains the same in the non-expanded X or Y dimension).

By way of further example, application of tension to increase/decrease a length and/or width of a dynamic material 100 in a plane correspondingly increases/decreases a thickness of the dynamic material 100 out of the plane, in accordance with example embodiments.

In addition to increasing the thickness of a dynamic material 100 (e.g., to provide for length and/or width adjustability of an article of footwear), the change of a dynamic material 100 from a closed configuration to an open configuration can provide for increased padding, insulation or ventilation, as described below.

In an "open configuration," adjacent layers of a dynamic material of the present disclosure are spaced further apart from one another than when in a closed configuration, or apertures of a single layer of a dynamic material of the present disclosure are open. In a "closed configuration," adjacent layers of a dynamic material of the present disclosure are spaced closer to one another than when in a open configuration, or apertures of a single layer of a dynamic material of the present disclosure are closed. The dynamic material 100 can be configured to be locked in the open and/or closed configuration.

Thus, in some embodiments, the dynamic material is configured to exhibit a topographic transformation along a first axis in response to a tension being applied to the dynamic material along a second axis orthogonal to the first axis, and the topographic transformation alters at least one of a fit, padding, an insulation, or a ventilation, of the article of footwear.

In other embodiments, the dynamic material is configured to exhibit an increase in a thickness in response to an increase in length or width, and the increase in the thickness alters at least one of a fit, padding, an insulation, or a ventilation, of the article of footwear.

In still other embodiments, the dynamic material is configured to exhibit a topographic transformation in a first plane in response to a tension being applied to the dynamic material in a second plane out of the first plane, and the topographic transformation alters at least one of a fit, padding, an insulation, or a ventilation, of the article of footwear.

In accordance with example embodiments, the out of plane or orthogonal axis expansion of the dynamic material 100 is reversible in connection with tension no longer being applied to the dynamic material 100 in the plane or along the axis, as the case may be. In this regard, the dynamic material 100 can comprise a resiliently deformable material, e.g., an elastic or shape-memory material.

In accordance with example embodiments, the described topographic transformation can be achieved by the dynamic material 100 comprising a single layer having a plurality of angled or curved slits 120, wherein application of tension to expand the dynamic material 100 in a plane causes a plurality of angled or curved slit edges 121 of the dynamic material 100 to project out of the plane. This can be accomplished by a pattern of slits having of a plurality of linear and v-shaped or u-shaped slits alternating in orthogonal directions. Thus, in example embodiments, the dynamic material comprises a plurality of angled or curved slits 120 configured to expand along the first axis as an auxetic structure. FIGS. 1A and 1B illustrate an example dynamic material 100 in a closed configuration and an open configuration, respectively.

While a dynamic material 100 comprising a plurality of angled or curved slits 120 is contemplated herein, the present disclosure more broadly encompasses other slit patterns configured to behave similarly, for example, having other elliptical, non-elliptical, or random shapes.

As used herein, an "elliptical" shape refers to any shape that generally lacks a point where two lines, curves, or surfaces converge to form an angle. For example, an "elliptical" shape encompasses traditional Euclidian geometric shapes such as circles and ellipses, as well as other non-angular shapes (that lack any angles), even if those shapes do not have designations common in Euclidian geometry.

As used herein, a "non-elliptical" shape refers to any shape that includes at least one point where two lines, curves, or surfaces converge to form an angle. For example, a "non-elliptical" shape encompasses traditional Euclidian geometric shapes such as triangles, rectangles, squares, hexagons, trapezoids, pentagons, stars, and the like as well as other shapes that have at least one angle even if those shapes do not have designations common in Euclidian geometry.

Figure 2A:
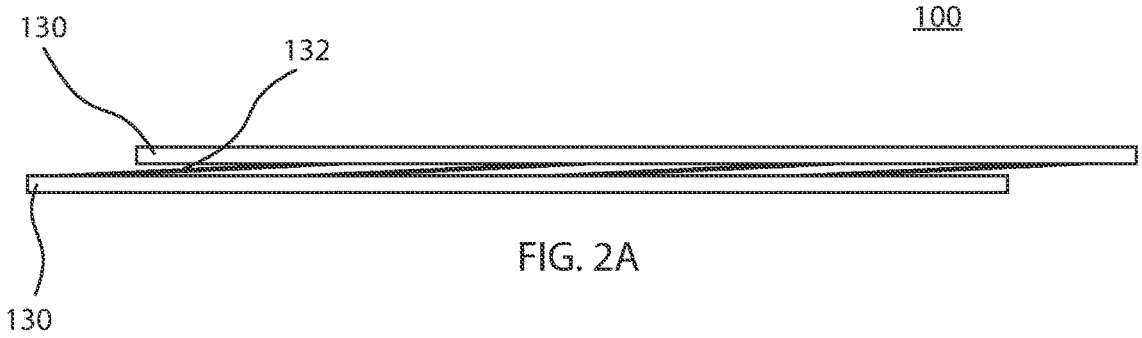
FIGS. 2A-2C progressively illustrate a dynamic material comprising two layers, in accordance with an example embodiment of the present disclosure, being adjusted from a closed configuration to an open configuration.
Figure 2B:
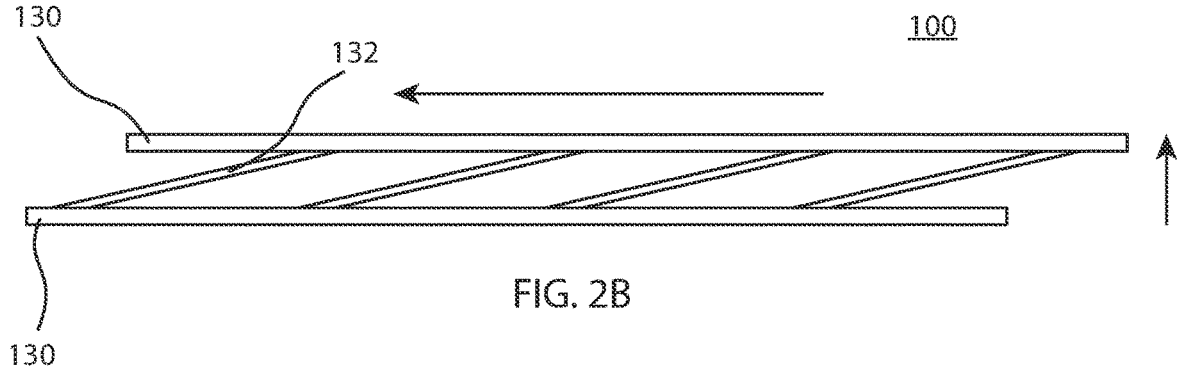
Figure 2C:
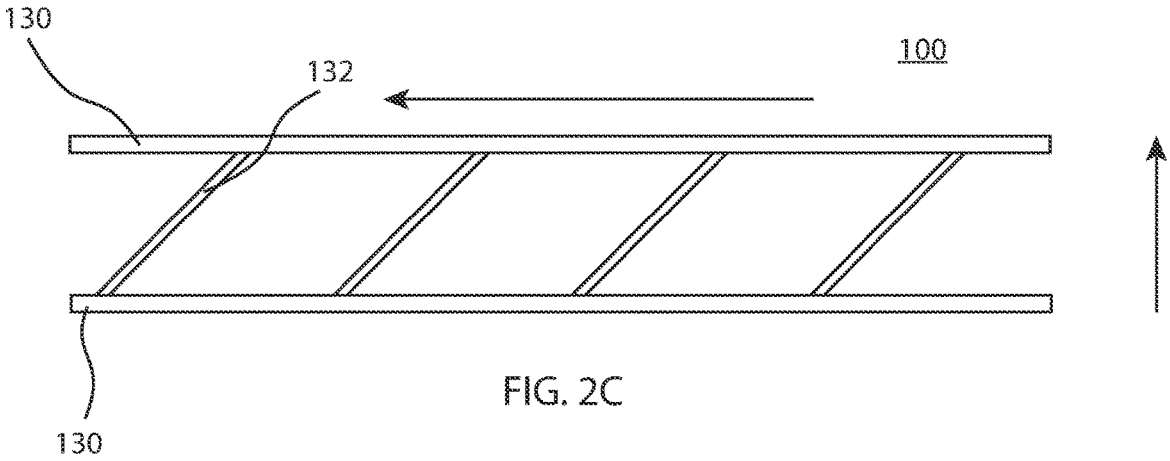

In other embodiments, and with reference to FIGS. 2A-2C, topographic transformation of the dynamic material 100 can be achieved by the dynamic material 100 being comprised of a plurality of layers 130 coupled together by a plurality of ribs 132, in some embodiments, arranged in series parallel to one another, in other embodiments, to cross over and shear past one another when the dynamic material 100 is transforming from a closed to an open configuration.

As used herein, a rib can be a baffle, blade or the like, and can be comprised of one or more rigid or semi-rigid fibers or materials, for example, nylon, polypropylene, polyethylene, polyurethane, carbon fiber, shape-memory polymer, thermoplastic rubber (TPR), silicone, styrene-ethylene/butylene-styrene (SEBS), acetal homopolymer/polyoxymethylene, aluminum, TPU, TPC-ET, acrylic resin, rubber, ABS, or polycarbonate, or another rigid or semi-rigid fiber or material known in the art or hereinafter developed. In example embodiments, a rib 132 is at least as rigid as opposing layers 130 of a dynamic material 100. In this regard, a plurality of ribs 132 in a zone can impart greater axial strength to the dynamic material 100 than shear strength in the zone, to provide ample topographical lift compared to the external pressures inside a shoe.

In such embodiments, the ribs 132 can be configured to fold, bend, rotate, or curve relative to the layers 130, yet provide axial support between the layers 130 when the dynamic material 100 is in the open configuration. In this regard, in example embodiments, when a first layer 130 is moved along a first axis relative a second layer 130, the ribs 132 can be configured to fold, bend, rotate, or curve to project the layer 130 along a second axis orthogonal to the first axis (e.g., change the distance between the layers 130). FIGS. 2A-2C progressively illustrate the dynamic material 100 being adjusted from a closed configuration to an open configuration. In an open configuration, a plurality of ribs 132 can be orthogonal to a layer 130 (and, in some embodiments, biased to fold, bend, rotate, or curve a desired direction), while in a closed configuration, a plurality of ribs 132 can be angled relative to a layer 130. In other embodiments, a plurality of ribs 132 can simply be angled more relative to a layer 130 in an open configuration than in a closed configuration.

In some embodiments, a rib is coupled to a layer by adhesion, fusion (e.g., heat fusion, as described below) or interlocking elements, while in other embodiments, a rib and a layer are an integral or unitary material.

While proportional in some embodiments, in other embodiments the distance of translation of a layer 130 along an axis resulting from an applied tension is not necessarily equal to the distance of topographic translation of the layer 130 along an orthogonal axis.

In some embodiments, at least one rib of the plurality of ribs 132 is longer than the distance between it and any adjacent rib of the plurality of ribs. In some embodiments, all ribs of the plurality of ribs 132 are longer than the distance between them and any adjacent rib of the plurality of ribs.

In example embodiments, the topographic transformation of the dynamic material 100 is not constant, for example, across the dynamic material 100, layers 130 can be comprised of different materials, ribs 132 can be comprised of different materials, ribs 132 can comprise inconsistent spacing, and/or ribs 132 can comprise inconsistent lengths.

Figure 3A:
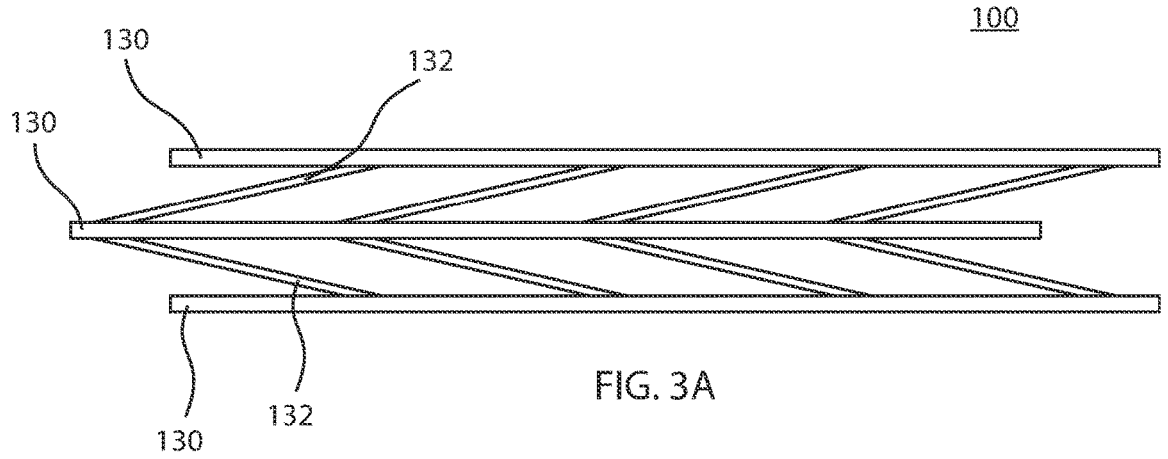
FIGS. 3A and 3B illustrate a dynamic material comprising three layers in partially closed and open configurations, respectively, in accordance with an example embodiment of the present disclosure.
Figure 3B:
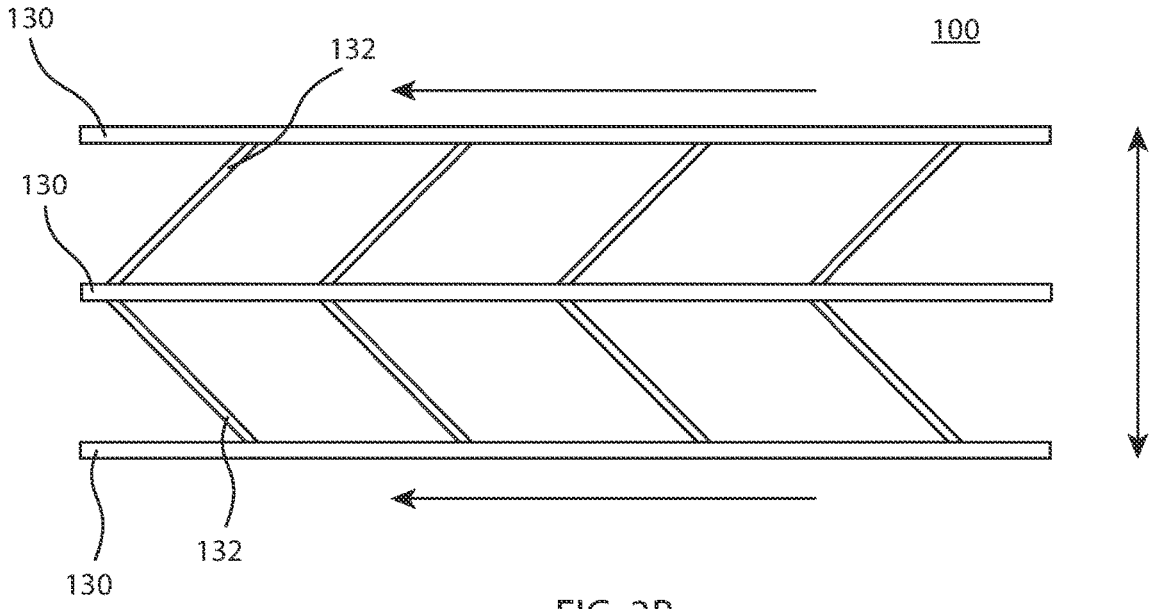

FIGS. 3A and 3B illustrate an alternate embodiment of a dynamic material 100 having three layers 130 and a plurality of ribs 132. In such an embodiment, a first row of ribs 132 can be oriented perpendicular to an adjacent second row of ribs 132 when the dynamic material 100 is in an open configuration. FIGS. 3A and 3B illustrate the dynamic material 100 in a partially closed configuration and an open configuration, respectively. In such embodiments, a rib 132 can have a quadrilateral shape (e.g., rectangle or square). In other embodiments, a rib 132 can have an elongated shape (e.g., a fiber). In connection with the foregoing, a plurality of ribs 132 having elongated shapes (e.g., a plurality of fibers, effectively 1-dimensional) can be uniformly angled (or biased to fold, bend, rotate, or curve) in a common direction, but otherwise randomly spaced between opposing layers 130 of a dynamic material 100.

Figure 4A:
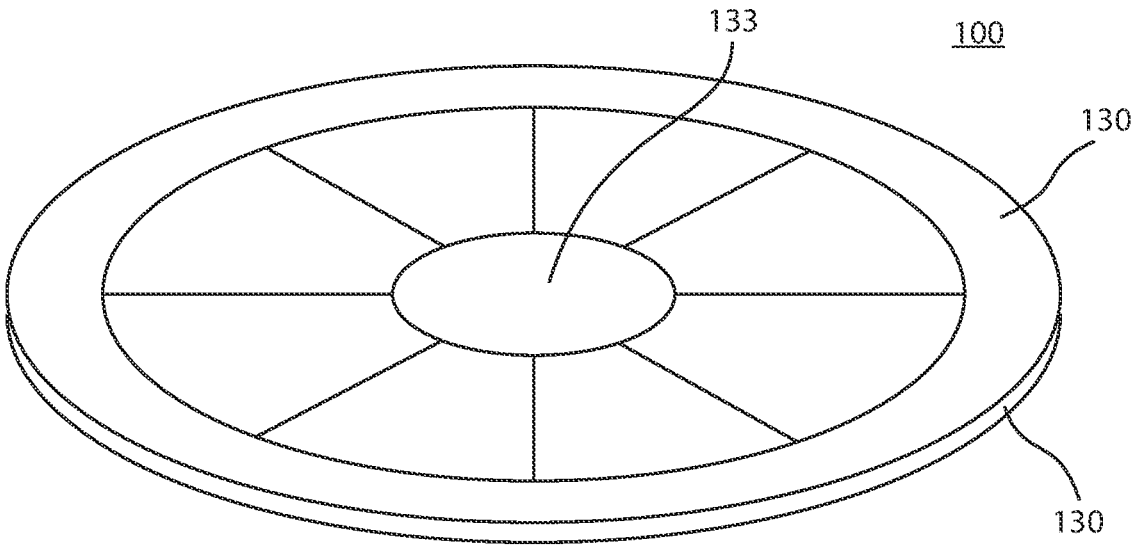
FIGS. 4A and 4B illustrate a dynamic material having a radial rib pattern in closed and open configurations, respectively, in accordance with an example embodiment of the present disclosure.
Figure 4B:
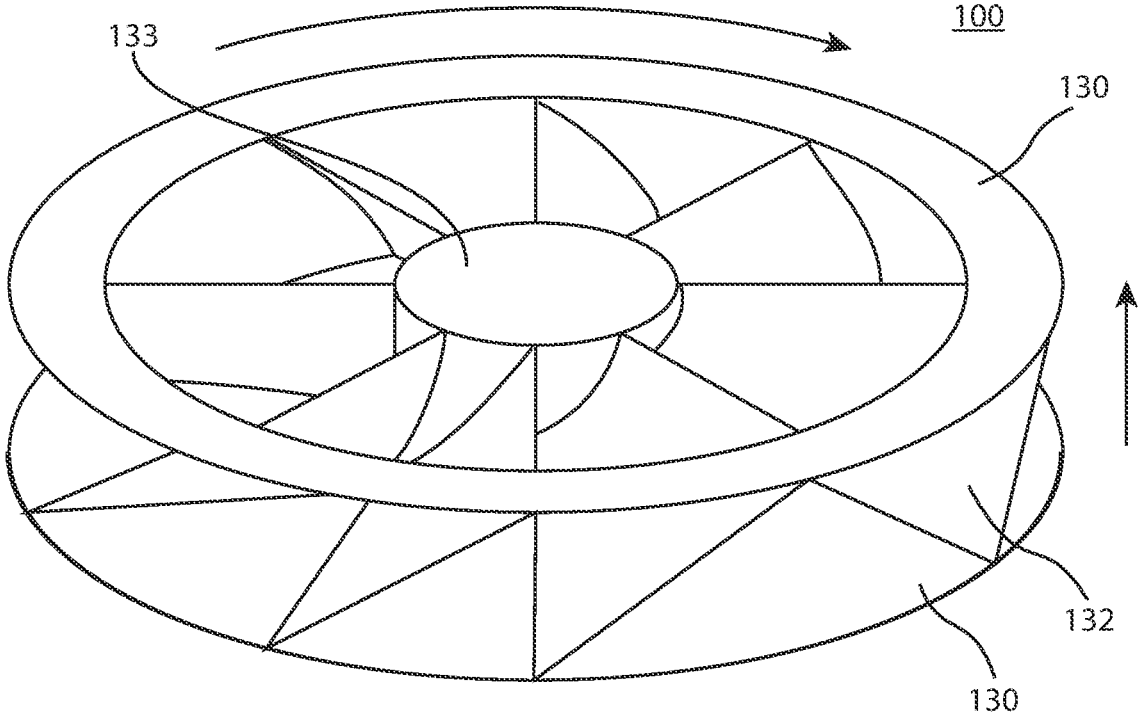

FIGS. 4A and 4B illustrate yet an alternate embodiment with two layers 130 and a plurality of ribs 132 arranged in a radial pattern (rather than a linear pattern, as described above), extending from a central hub 133. In such embodiments, rather than a tension being applied to a layer as with a linear pattern, a torque can be applied to a layer (e.g., in a direction illustrated by the curved arrow in FIG. 4B). Once a torque is applied, similar to above, the ribs 132 can be configured to fold, bend, rotate, or curve to thereby affect the distance between the layers 130. In this regard, the ribs 132 of an example embodiment can extend at an angled orientation from the central hub 133 (e.g., offset from a radial direction). FIGS. 4A and 4B illustrate the dynamic material 100 in a closed configuration and an open configuration, respectively. In such embodiments, an edge of a rib 132 can comprise a curve to engage with the central hub 133.

Figure 5A:
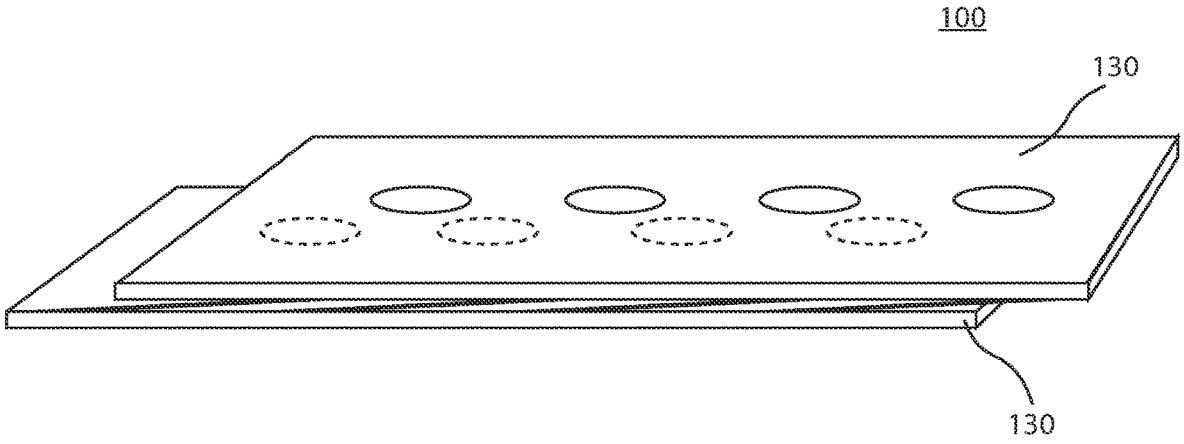
FIGS. 5A and 5B illustrate a dynamic material comprising two layers with apertures in closed and open configurations, respectively, in accordance with an example embodiment of the present disclosure.
Figure 5B:
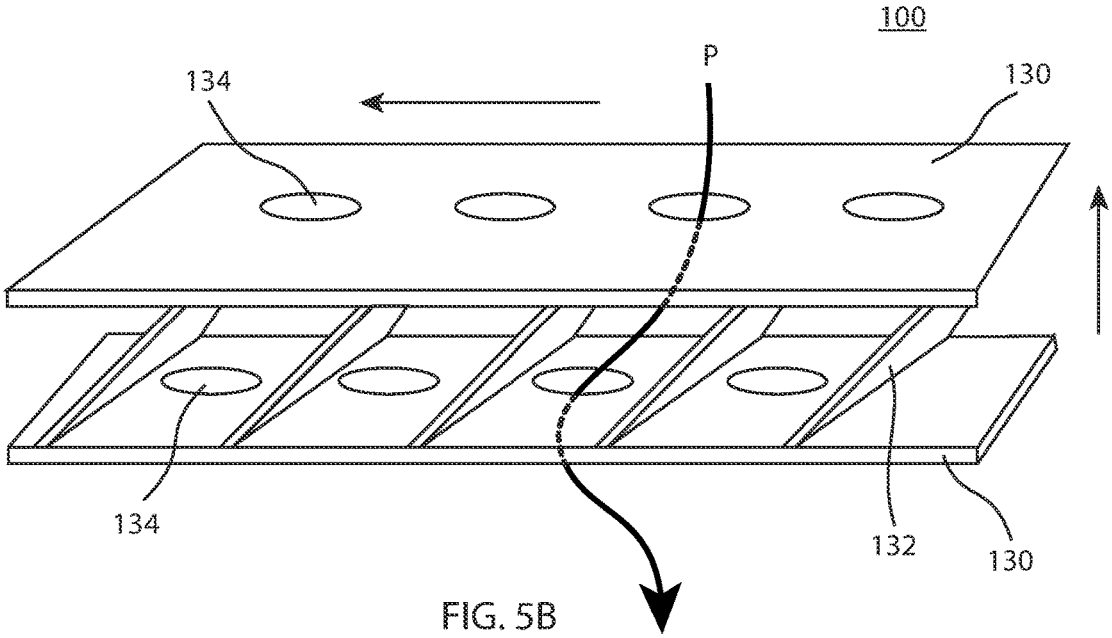

Whether in connection with materials comprising linear or radial rib patterns, and with reference to FIGS. 5A and 5B, layers 130 can comprise one or more apertures 134 to increase air flow along a path P when the dynamic material 100 is in the open configuration (FIG. 5B). When the dynamic material 100 is in its closed configuration, the apertures can be blocked by the layer 130. FIGS. 5A and 5B illustrate the dynamic material 100 in a closed configuration and an open configuration, respectively.

Figure 6A:
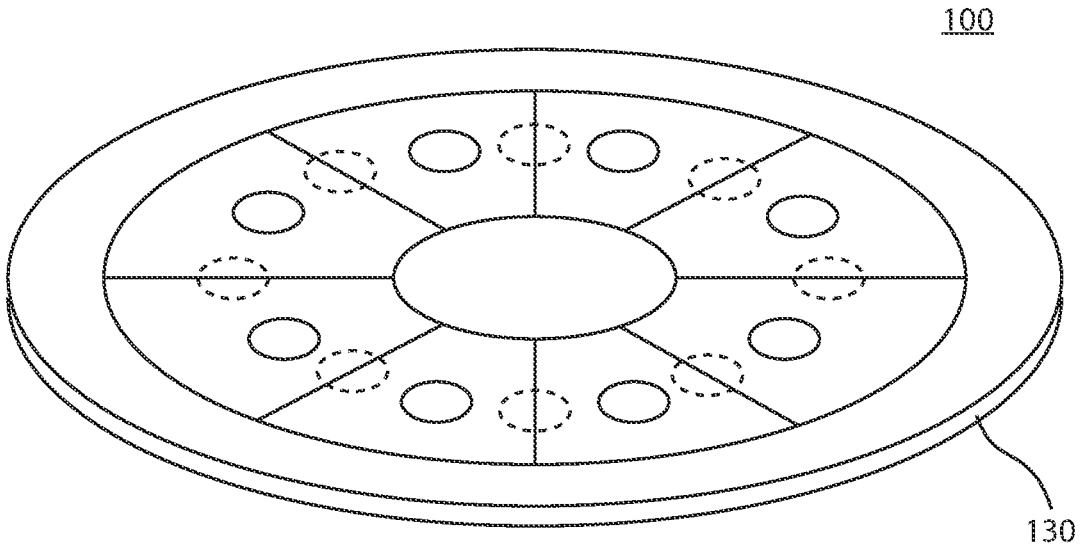
FIGS. 6A and 6B illustrate a dynamic material having a radial rib pattern with apertures in closed and open configurations, respectively, in accordance with an example embodiment of the present disclosure.
Figure 6B:
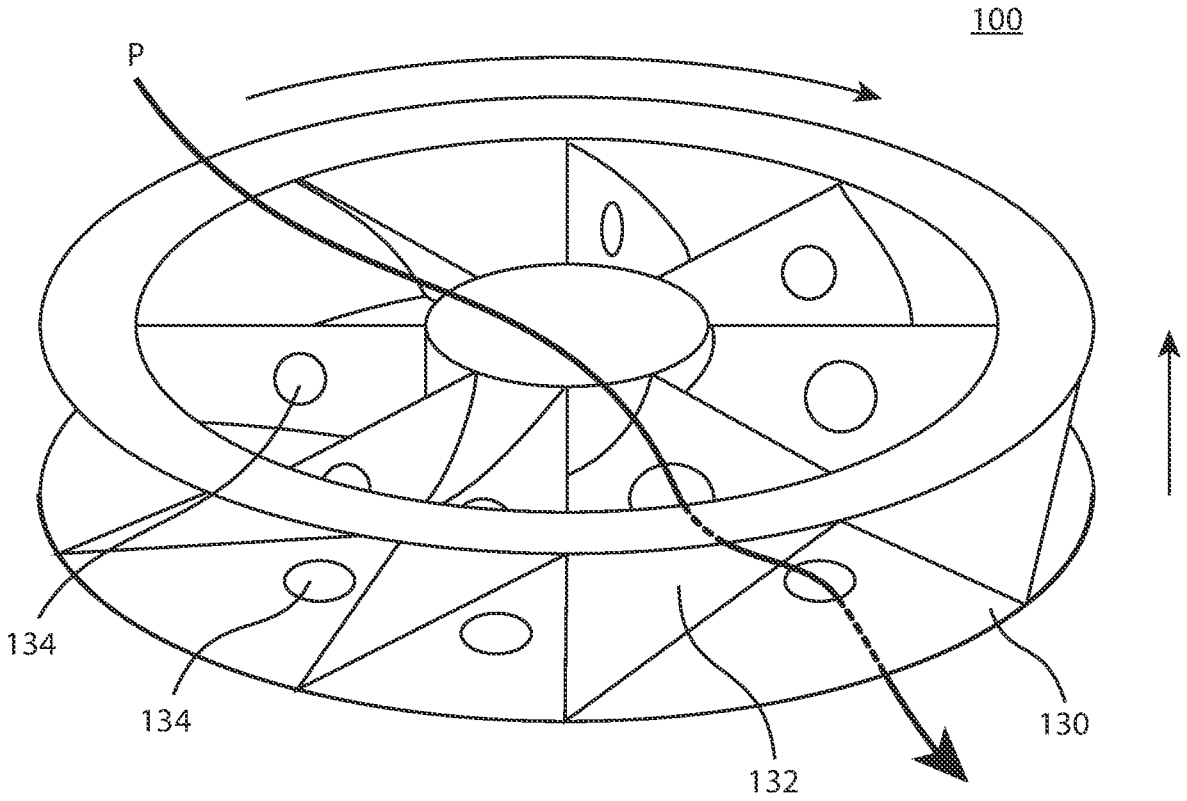

Similarly, whether in connection with materials comprising linear or radial rib patterns, and with reference to FIGS. 6A and 6B, rib 132 and a layer 130 can comprise one or more apertures 134 to increase air flow along a path P when the dynamic material 100 is in the open configuration (FIG. 6B). When the dynamic material 100 is in its closed configuration, the apertures can be blocked by the layer 130. FIGS. 6A and 6B illustrate the dynamic material 100 in a closed configuration and an open configuration, respectively.

Thus, in example embodiments, the dynamic material comprises a plurality of layers coupled by a plurality of ribs, each of the plurality of ribs being configured to fold, bend, rotate, or curve. In example embodiments, the ribs are linearly or radially aligned. In example embodiments, at least one of the layers comprises an aperture to provide the ventilation in connection with the topographic transformation.

In accordance with example embodiments, a portion of the upper consist of the dynamic material 100. In accordance with other example embodiments, the dynamic material 100 can be incorporated into an upper of a shoe, for example, on an inner or an outer surface, or between two surfaces, of the upper. In example embodiments, the dynamic material 100 can be selectively coupled (e.g., not over the slits) such that tension or torque applied to the dynamic material 100 in a plane (e.g., and secured by a hook and loop fastener, button, clip or the like) causes topographic transformation to expand the dynamic material 100 out of the plane (and thereby reduce a dimension inside the upper).

Figure 7A:
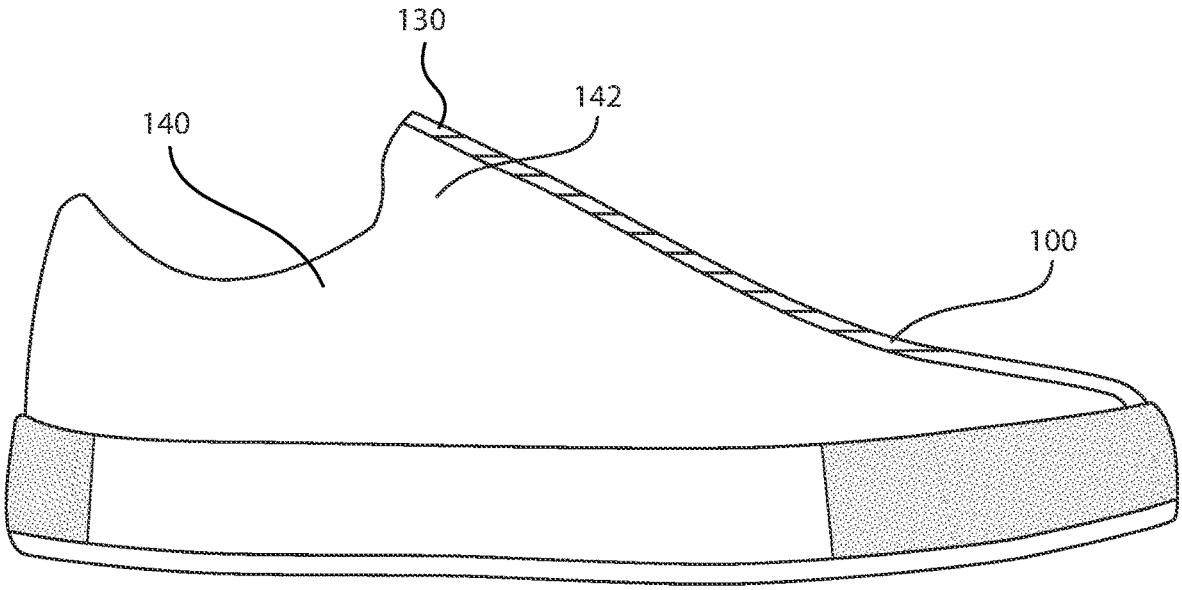
FIGS. 7A and 7B illustrate a dynamic material in a tongue of a shoe in accordance with an example embodiment of the present disclosure.
Figure 7B:
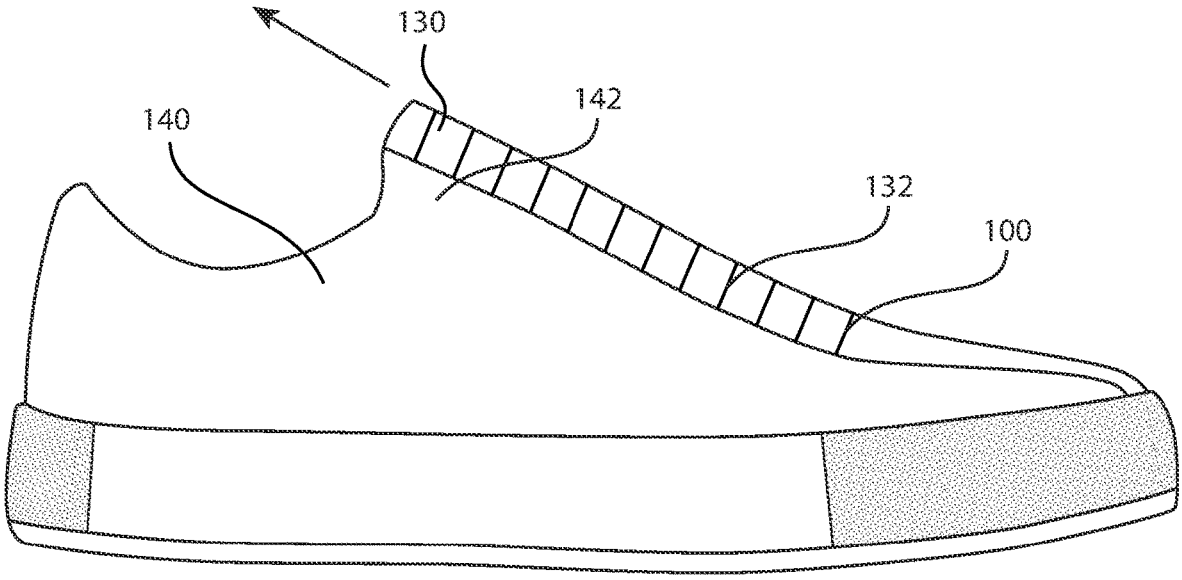
Figure 8A:
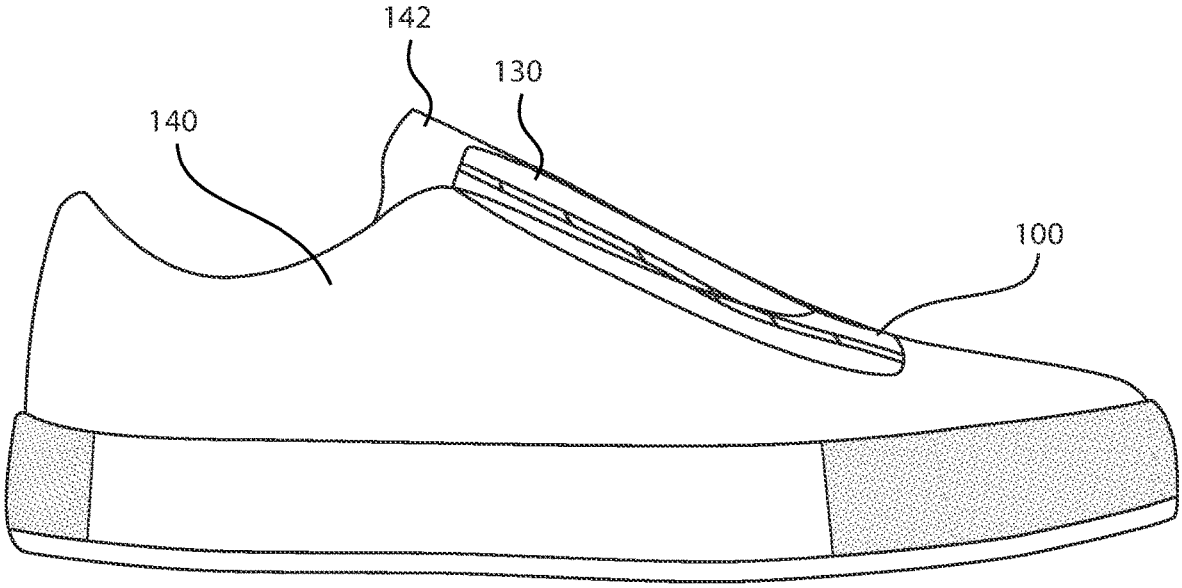
FIGS. 8A and 8B illustrate a different dynamic material in a tongue of a shoe in accordance with an example embodiment of the present disclosure.
Figure 8B:
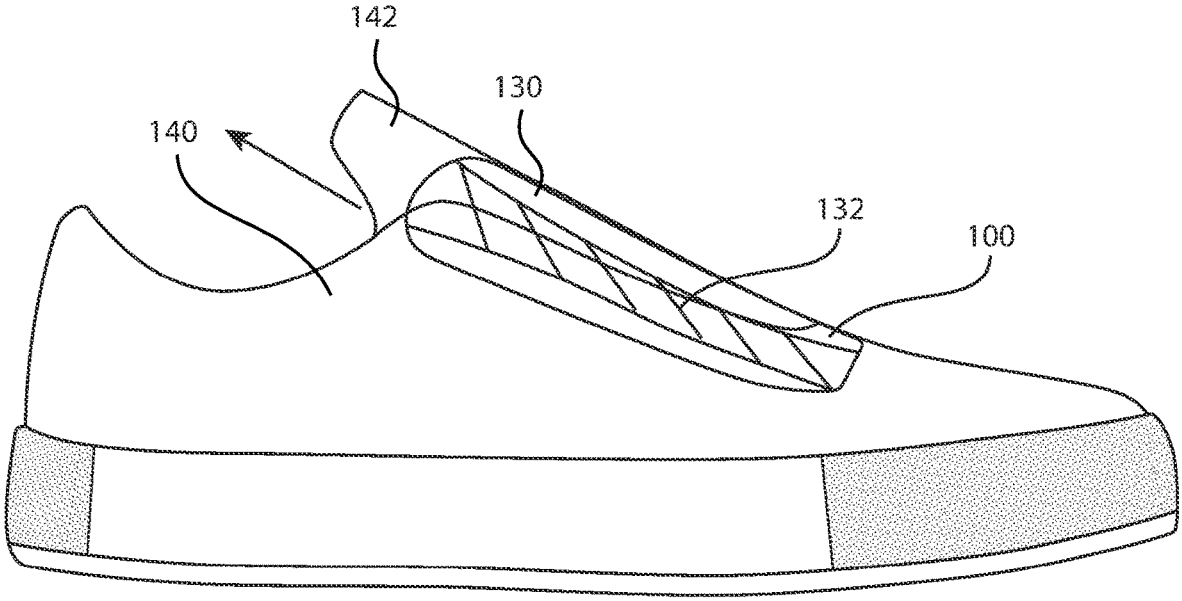

In accordance with example embodiments, the dynamic material 100 can be incorporated into a tongue portion 142 of an upper 140. With specific reference to FIGS. 7A and 7B, when a top layer 130 of the tongue portion 142 (comprised of the dynamic material 100) is actuated relative to a fixed bottom layer of the tongue portion 142, a plurality of ribs 132 unfold to increase the distance between the top layer 130 and the bottom layer. Alternatively, and with reference to FIGS. 8A and 8B, when a bottom layer 130 of the tongue portion 142 (comprised of the dynamic material 100) is actuated relative to a fixed top layer of the tongue portion 142, a plurality of ribs 132 unfold to increase the distance between the top layer 130 and the bottom layer.

Figure 9A:
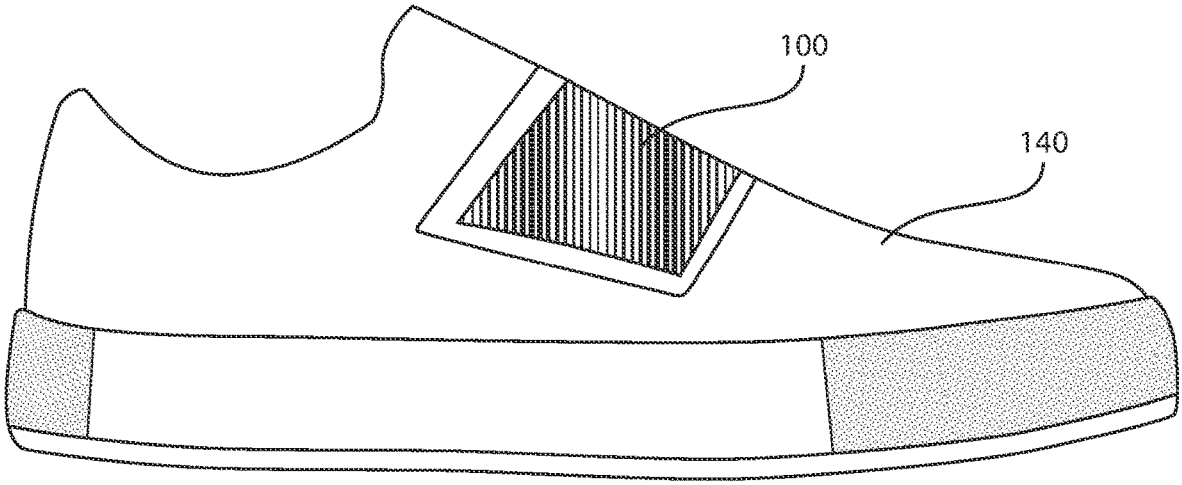
FIGS. 9A-9D illustrate example locations a dynamic material of the present disclosure may be incorporated into the upper of a shoe.
Figure 9B:
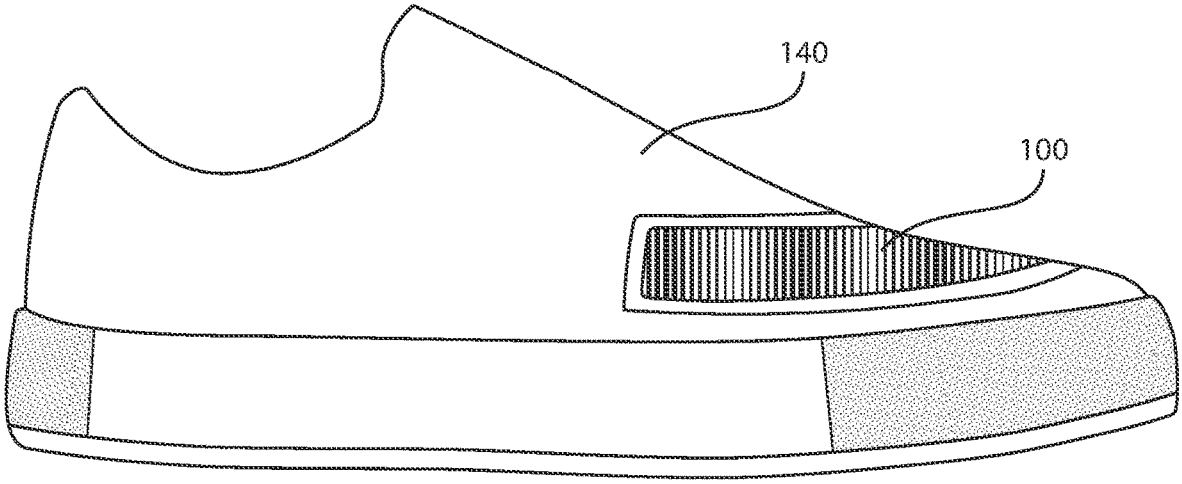
Figure 9C:
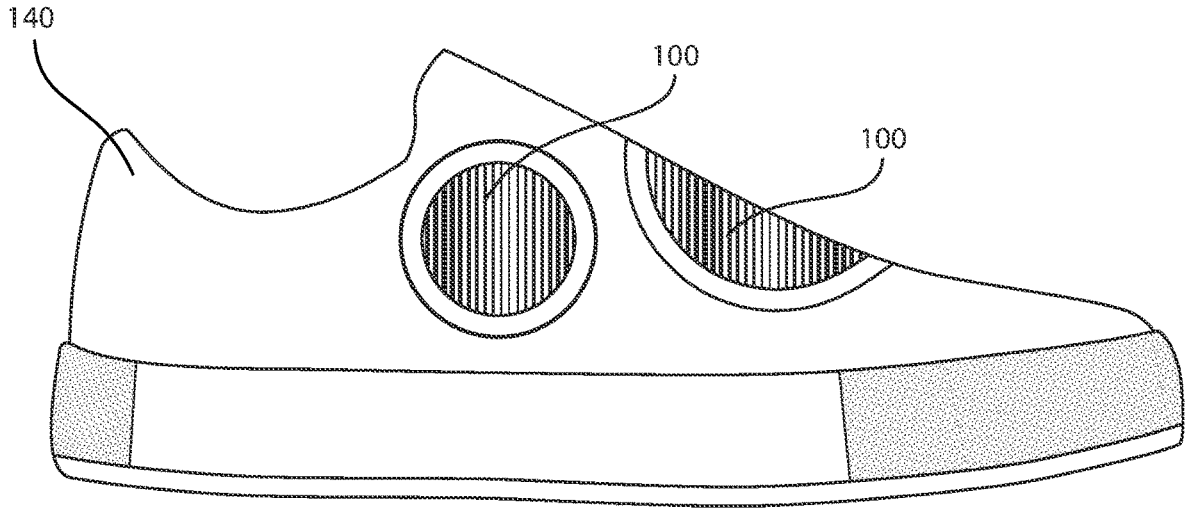
Figure 9D:
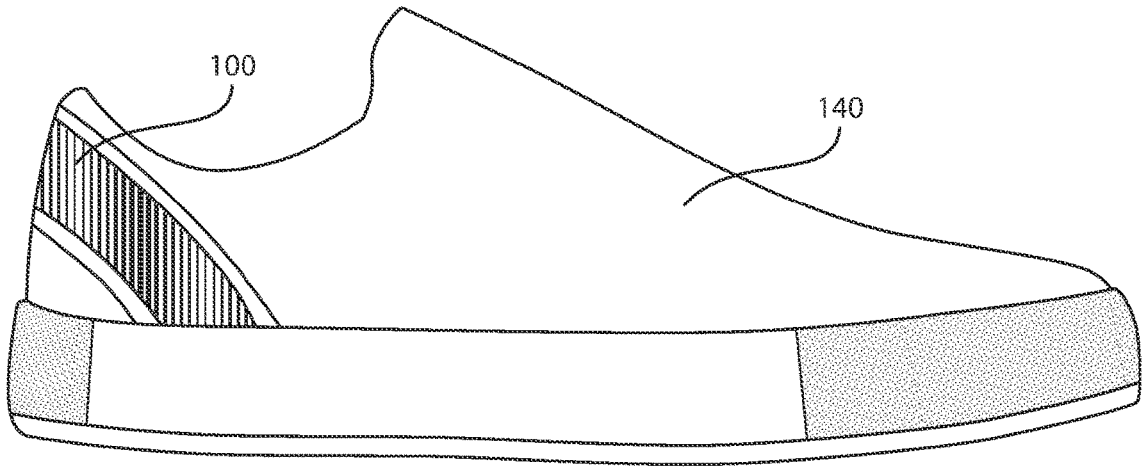

Notwithstanding the foregoing, the dynamic material 100 can be incorporated into any surface of an upper 140 to provide for length and/or width adjustability of the shoe, for example, a vamp portion (FIG. 9A), a toe box portion (FIG. 9B), a quarter portion (FIG. 9C), or a heel portion (FIG. 9D).

Figure 10:
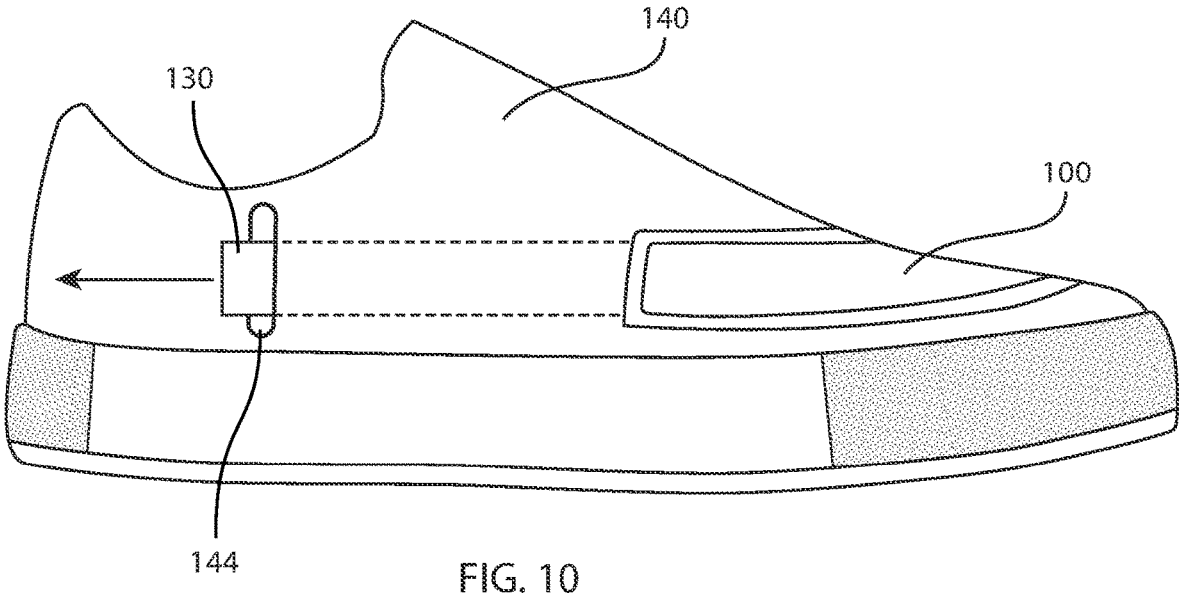
FIG. 10 illustrates access through an upper to end of a layer of a dynamic material in accordance with an example embodiment of the present disclosure.

With reference to FIG. 10, in connection with the foregoing embodiments, an end of a layer 130 of a dynamic material 100 (to be actuated by the application of tension or torque relative to another layer of the dynamic material coupled to the layer 130 by a plurality of ribs configured to fold relative to the adjacent layers) can be accessed through one or more apertures 144 in an upper 140, the one or more apertures 144 being distanced from the dynamic material 100.

In some embodiments, the dynamic material 100 is biased in an open configuration, while in other embodiments, the dynamic material 100 is biased in a closed configuration. In still other embodiments, the dynamic material 100 is bistable (i.e., in both an open configuration and a closed configuration).

In some embodiments, securement in and/or transition between, open and closed configurations, which may be incremental, is facilitated by one or more of a belt, ratchet (e.g., a zip-tie mechanism), cord, strap with hook and loop fasteners, or the like, in some embodiments with a quick release, surrounding all or a portion of the upper. In other embodiments, securement in and/or transition between, open and closed configurations, is facilitated by an air bladder. In still other embodiments, securement in and/or transition between, open and closed configurations, is facilitated by a cord or the like extending through one or more spaces between upper parts, which may further be driven by a cam system, e.g., including an eccentric wheel. Moreover, a dynamic material 100 in accordance with the present disclosure may comprise one or more visual, tactile or audible indicators of adjustment (e.g., a click every 2 mm or a mark corresponding to 2 mm).

To further accommodate adjustment to length and/or width of the upper, the upper may be comprised of an expandable material (e.g., a knit, stretch or elastic material), comprise one or more gussets or gores, and/or comprise overlapping or folding panels. Additionally, a shoe in accordance with the present disclosure may comprise one or more features to accommodate length and/or width adjustability of the shoe, for example, one or more expandable/collapsible apertures, gussets, gores, overlapping or folding panels, or the like.

Figure 11A:
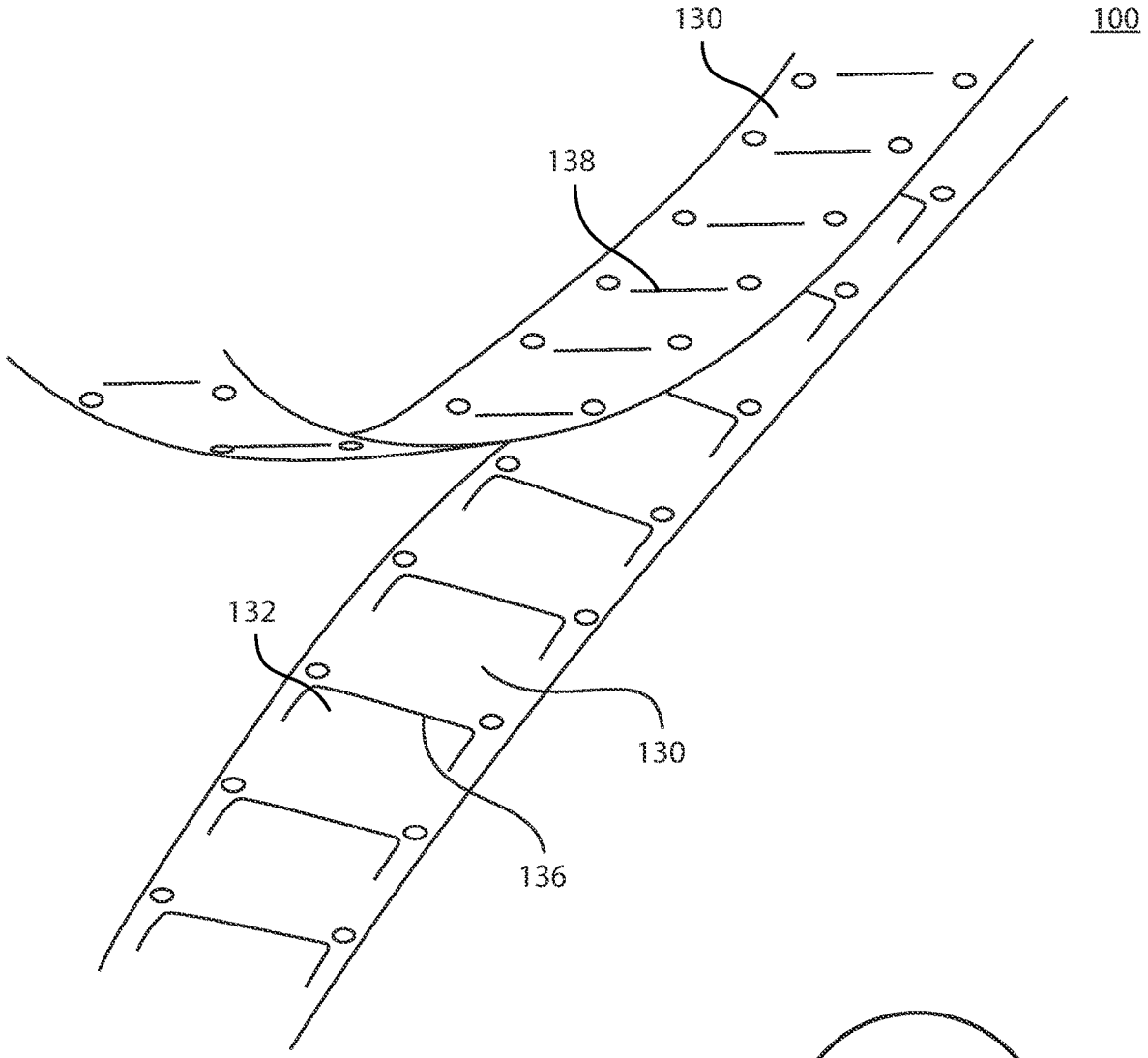
FIGS. 11A and 11B illustrate a method of making a dynamic material of the present disclosure.
Figure 11B:
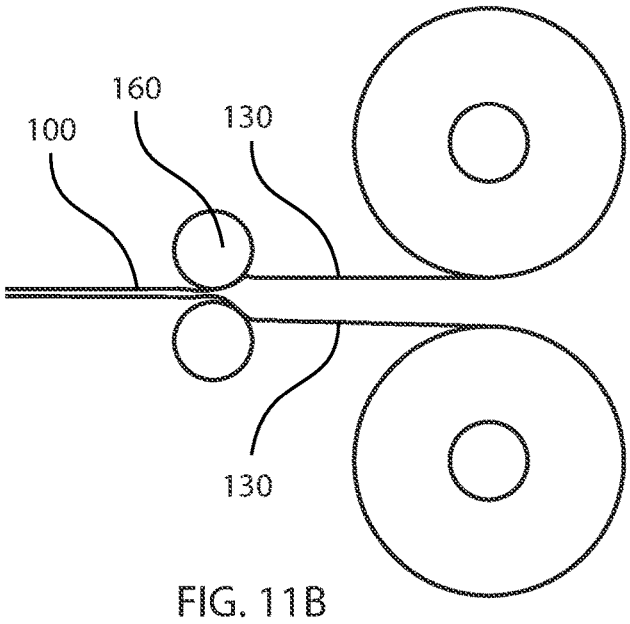

A method of making a dynamic material 100 is also contemplated herein. With reference to FIGS. 11A and 11B, a plurality of linear slits 138 through a first layer 130 of dynamic material 100 can be heat fused to the edges 136 of a plurality of ribs 132 formed by u-shaped slits through a second layer 130 of dynamic material 100. The layers 130 can be rolled through a heat fusion device 160 to output a dynamic material 100 finished for use in connection with the present disclosure.

Figure 12:
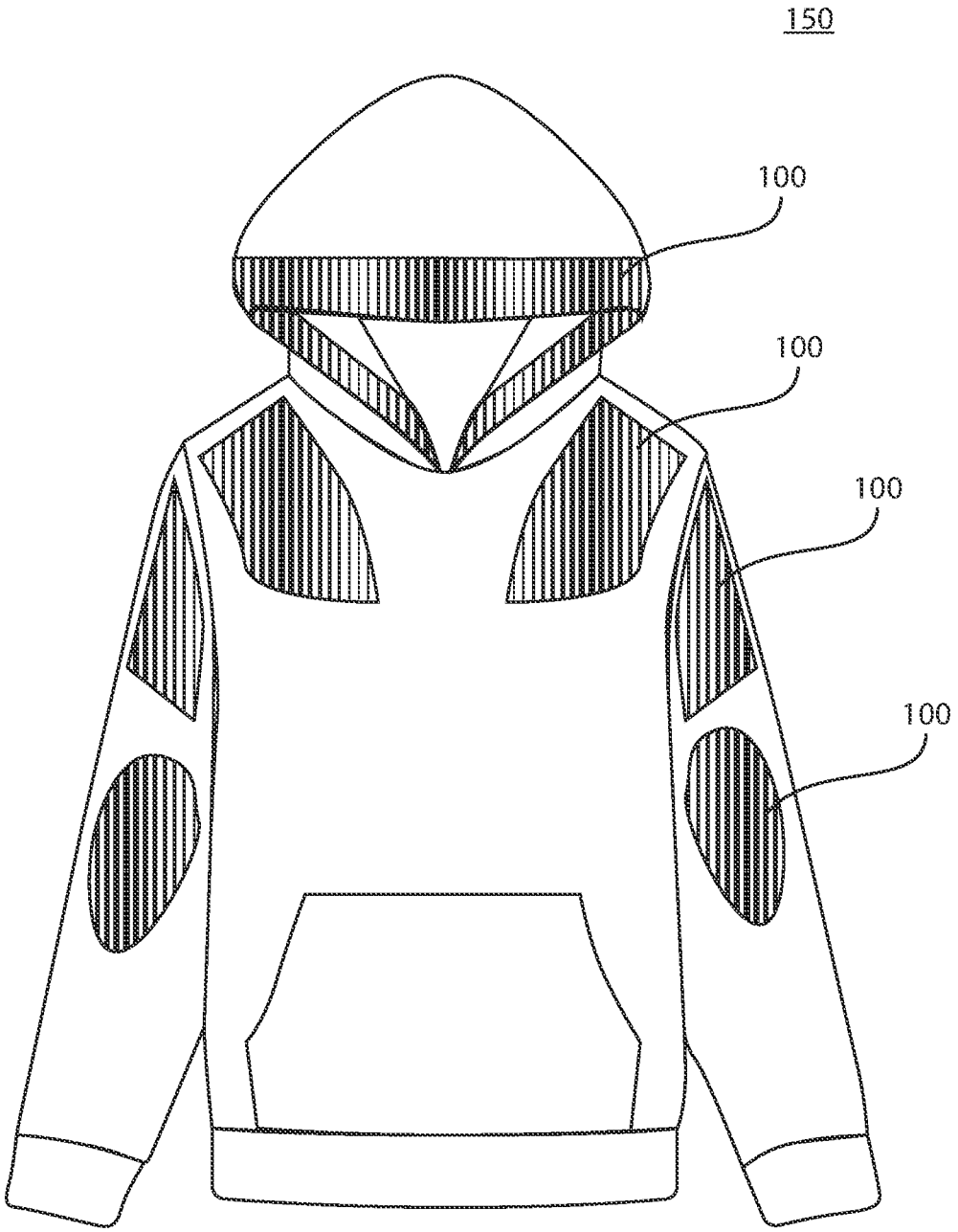
FIG. 12 illustrates a hoodie comprising a dynamic material of the present disclosure.

Finally, while the present disclosure has been described primarily with reference to an article of footwear, it will be apparent to those skilled in the art that the present disclosure may be more broadly applied, for example, and with reference to FIG. 12, to an article of clothing such as a hoodie 150 comprising a dynamic material 100 in one or more locations.

It will be apparent to those skilled in the art that various modifications and variations can be made in the present disclosure without departing from the spirit or scope of the disclosure. Thus, it is intended that the embodiments described herein cover the modifications and variations of this disclosure provided they come within the scope of the appended claims and their equivalents.

Numerous characteristics and advantages have been set forth in the preceding description, including various alternatives together with details of the structure and function of the devices and/or methods. The disclosure is intended as illustrative only and as such is not intended to be exhaustive. It will be evident to those skilled in the art that various modifications can be made, especially in matters of structure, materials, elements, components, shape, size and arrangement of parts including combinations within the principles of the invention, to the full extent indicated by the broad, general meaning of the terms in which the appended claims are expressed. To the extent that these various modifications do not depart from the spirit and scope of the appended claims, they are intended to be encompassed therein.

We claim:

1. An article of footwear comprising:

a sole structure, and an upper coupled to the sole structure, the upper comprising an upper panel, wherein the upper panel comprises a dynamic material, wherein the dynamic material comprises a first layer and a second layer, the first layer and the second layer separated by a plurality of aligned ribs, wherein a first rib of the plurality of aligned ribs is aligned with a second rib of the plurality of aligned ribs, wherein the ribs are configured to fold in response to an external force causing a relative motion between the first layer and the second layer, and wherein the relative motion alters at least one of a fit, an insulation, or a ventilation of the article of footwear.

2. The article of footwear of claim 1, wherein the ribs are linearly aligned.

3. The article of footwear of claim 1, wherein the ribs are radially aligned.

4. The article of footwear of claim 1, wherein at least one of the layers comprises an aperture to provide the ventilation in connection with the topographic transformation.

5. The article of footwear of claim 1, wherein an end of the dynamic material extends through an aperture in the upper for application of the external force by a user.

* * * * *